US009955766B2

(12) United States Patent
Bell et al.

(10) Patent No.: US 9,955,766 B2
(45) Date of Patent: May 1, 2018

(54) ROLL-ON LIQUID APPLICATOR

(71) Applicants: James Bell, Eastchester, NY (US); Scott Bell, Stamford, CT (US)

(72) Inventors: James Bell, Eastchester, NY (US); Scott Bell, Stamford, CT (US)

(73) Assignee: DAB-O-MATIC, CORP., Mt. Vernon, NY (US)

( * ) Notice: Subject to any disclaimer, the term of this patent is extended or adjusted under 35 U.S.C. 154(b) by 0 days. days.

(21) Appl. No.: 15/542,900

(22) PCT Filed: Jun. 10, 2016

(86) PCT No.: PCT/US2016/036810
§ 371 (c)(1),
(2) Date: Jul. 11, 2017

(87) PCT Pub. No.: WO2016/209638
PCT Pub. Date: Dec. 29, 2016

(65) Prior Publication Data

US 2018/0000223 A1 Jan. 4, 2018

Related U.S. Application Data

(60) Provisional application No. 62/184,038, filed on Jun. 24, 2015, provisional application No. 62/256,364, filed on Nov. 17, 2015.

(51) Int. Cl.
*A45D 34/04* (2006.01)

(52) U.S. Cl.
CPC ..... *A45D 34/041* (2013.01); *A45D 2200/054* (2013.01)

(58) Field of Classification Search
CPC combination set(s) only.
See application file for complete search history.

(56) References Cited

U.S. PATENT DOCUMENTS

| | | | | |
|---|---|---|---|---|
| 600,299 | A | 3/1898 | Werner | |
| 2,663,891 | A | 12/1953 | Hanryon | |
| 3,647,120 | A | 3/1972 | Steiman | |
| 4,588,320 | A * | 5/1986 | Weinstein | A45D 34/041 400/209 |
| 4,723,860 | A | 2/1988 | Giblin et al. | |

(Continued)

FOREIGN PATENT DOCUMENTS

GB 1 515 078 6/1978

*Primary Examiner* — David Walczak
(74) *Attorney, Agent, or Firm* — Cozen O'Connor

(57) ABSTRACT

A roll-on liquid applicator having an applicator ball disposed within a dispensing chamber and a spring element with a valve head portion. The spring element effects a distally-directed force to press the valve head against the valve opening to maintain a sealing closure of the valve opening against flow of the liquid from the feed chamber into the dispensing chamber. The valve head has a ball support structure which extends distally through the valve opening to contact with the applicator ball so that when the ball is inwardly displaced by force applied thereto, the valve head moves axially inward from the closed-valve position to the open-valve position, thereby moving the valve head from the closed-valve position in contact with the valve opening toward the open-valve position which allows liquid from the feed chamber to enter the dispensing chamber.

23 Claims, 10 Drawing Sheets

(56) References Cited

U.S. PATENT DOCUMENTS

| | | | | |
|---|---|---|---|---|
| 5,810,495 | A | 9/1998 | McAuley | |
| 7,914,222 | B2 * | 3/2011 | Inoue | B43K 1/084 15/445 |
| 2014/0010582 | A1 | 1/2014 | Arminak | |

* cited by examiner

ROLL-ON LIQUID APPLICATOR

CROSS-REFERENCE TO RELATED APPLICATION

This is a U.S. national stage of application No. PCT/US2016/036810, filed on Jun. 10, 2016. This application claims priority to U.S. Provisional Patent Application No. 62/184,038, entitled "Improved Roll-On Application," filed Jun. 24, 2015; and U.S. Provisional Patent Application No. 62/256,364, entitled "Improved Roll-On Applicator and Cap Closure," filed Nov. 17, 2015, both of which are incorporated herein by reference in their entirety.

FIELD OF THE INVENTION

The disclosed embodiments relate to a roll-on liquid applicator. In particular, the disclosed embodiments relate to an applicator having a spring element with a valve head from which a ball support structure extends distally through a valve opening to contact an applicator ball.

BACKGROUND OF THE INVENTION

Liquid dispensers and dispensing applicators, such as roll-on applicators, are ubiquitous, providing an inexpensive and easily used vehicle for supplying a wide range of liquid-based products to the public. A common feature of such dispensers and applicators is the ability for the user to selectively effect a release or discharge of a typically internally-stored liquid through user-activation of a valving arrangement, commonly directly onto the intended surface, such as a skin surface. It will be appreciated that the usefulness and practicality of such liquid applicators is dependent on the ability of the valving arrangement to provide a uniform liquid application and to create and maintain an effect closure or seal against the release or leakage of stored liquid during times of nonuse.

SUMMARY OF THE INVENTION

The disclosed embodiments are directed to an improved roll-on applicator for user-initiated dispensing of liquid onto and through contact with a workpiece or worksurface, which may for example include a user's skin surface, and an associated demountable and disengageable cap for liquid-tightly closing the liquid discharge end of the applicator. The liquid is stored and dispensed from a container or bottle or the like (not shown in the figures) which is attached to the applicator to form an integrated and self-contained article. The inventive applicator provides particular enhancements in sealing against unintended liquid discharge and leakage and in controlling the volume and flow of liquid dispensed for application to the workpiece or other intended destination surface.

In one aspect, the present invention provides an applicator for liquid, including a housing having a feed chamber in communication with a dispensing chamber via a valve opening, an inlet at an axially proximal end of the housing through which a stored liquid is receivable in the feed chamber, and an outlet at an axially distal end of the housing through which the stored liquid is dispensable from the dispensing chamber. An applicator ball is disposed within the dispensing chamber and partially extends outward therefrom through the outlet. The dispensing chamber is configured to allow the applicator ball to move at least in an axial direction between a closed position and an open (i.e., application) position. The applicator ball is retained in the dispensing chamber by an annular lip at the distal end of the housing which extends radially inward. A spring element is disposed in the feed chamber and has a base portion and a valve head portion, the base portion being supported at a proximal end of the feed chamber. The valve head portion is moveable between a closed-valve position in which the valve head is in contact with the valve opening and an open-valve position in which the valve head is displaced in an axial direction with respect to the valve opening. The spring element is maintained in a compressed state such that the spring element applies, in both the closed-valve position and the open-valve position, distally-directed force to press the valve head against the valve opening to maintain a sealing closure of the valve opening against flow of the liquid from the feed chamber into the dispensing chamber. The valve head has a ball support structure which extends distally through the valve opening to contact with the applicator ball so that when the ball is inwardly displaced by force applied thereto, the valve head moves axially inward from the closed-valve position to the open-valve position, thereby moving the valve head from the closed-valve position in contact with the valve opening toward the open-valve position which allows liquid from the feed chamber to enter the dispensing chamber.

Embodiments of the present invention may include one or more of the following features.

The dispensing chamber may be configured along an interior surface thereof with a curvature that maintains a determined spacing between the interior surface and a surface of the applicator ball. The spacing between the interior surface and a surface of the applicator ball may diminish in a distal direction of the housing. A central portion of the ball support structure may have a higher elevation than a surrounding portion of the ball support structure, thereby forming a projection that extends distally to contact the applicator ball.

BRIEF DESCRIPTION OF THE DRAWINGS

The above and/or other aspects and advantages will become more apparent and more readily appreciated from the following detailed description of the disclosed embodiments taken in conjunction with the accompanying drawings of which.

DETAILED DESCRIPTION

Figure 2:
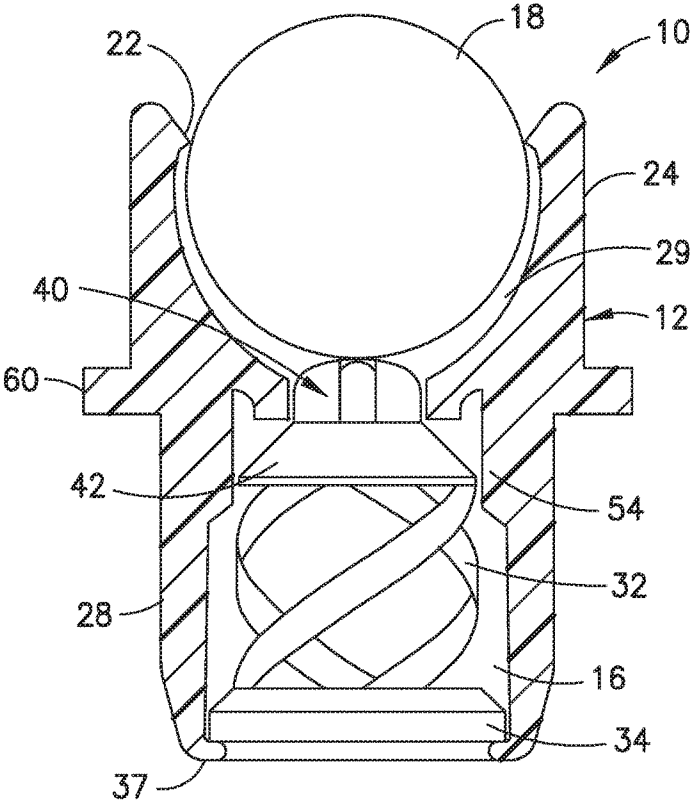
FIG. 2 is a cross-sectional view of a roll-on liquid applicator in which the applicator ball is in the open-valve position.
Figure 1:
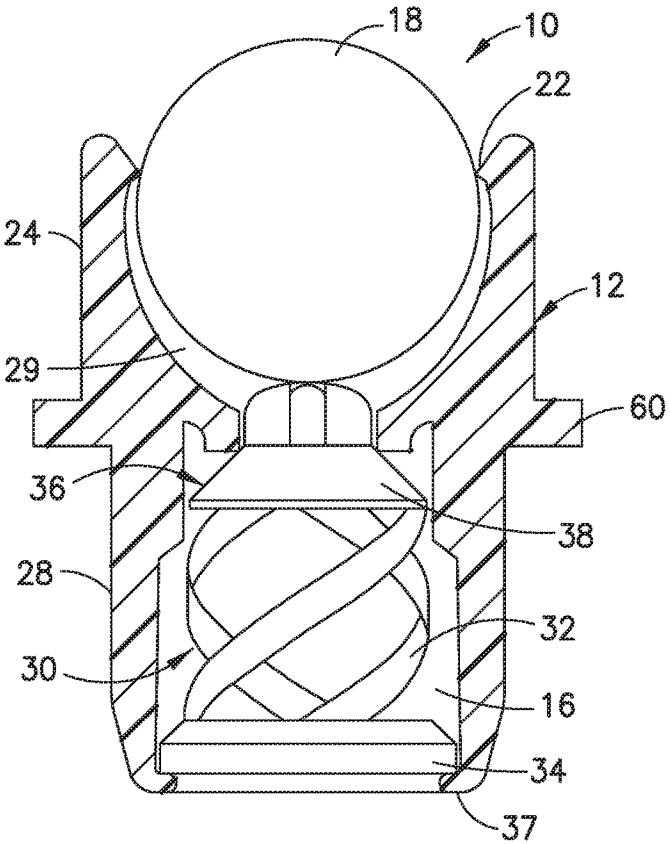
FIG. 1 is a cross-sectional view of a roll-on liquid applicator in which the applicator ball is in the closed-valve position.
Figure 5:
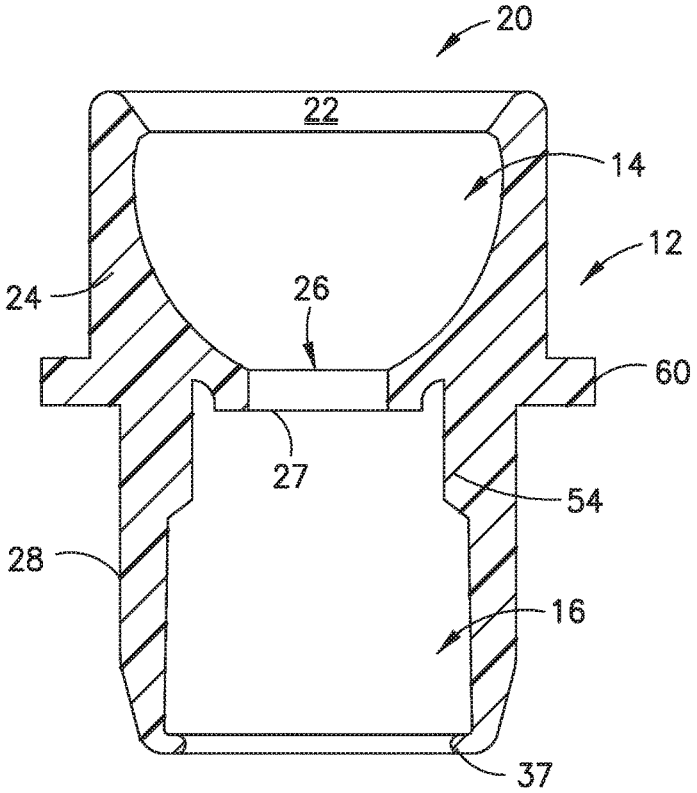
FIG. 5 is a cross-sectional view of the housing of the roll-on liquid applicator without the applicator ball and spring.
Figure 6:
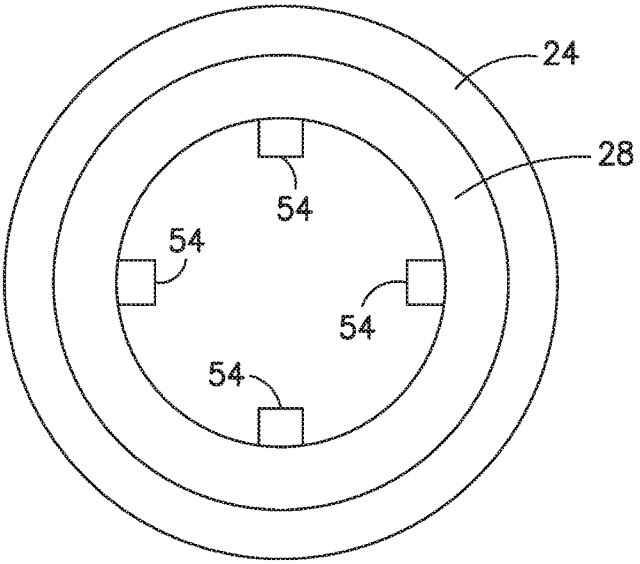
FIG. 6 is a bottom view of the housing of the roll-on liquid applicator, without the applicator ball and spring, showing the ribs in the feed chamber.

A cross-section of an embodiment of the applicator 10 is shown in its assembled form in FIGS. 1 and 2, each figure depicting a different operating condition of the device as will become clear. An applicator housing 12, shown separately in FIG. 5 and preferably formed as a unitary element that may be injection molded or otherwise formed of a plastic material such as nylon or polyolefin and acetal or the like, defines at its distal (i.e., upper) end a dispensing chamber 14 and at its proximal (i.e., lower) end a feed chamber 16. Dispensing chamber 14 is configured to cradle a liquid-applying spherical body or ball 18 that is disposed primarily within the chamber 14 but which partially protrudes or extends outwardly therefrom through a discharge opening 20. Ball 18 is retained or captured in chamber 14 by an annular lip 22 that is defined proximate the distal end of the lateral upper housing wall 24 and which extends radially inward and which under particular conditions may contact the surface of ball 18. In the illustrated embodiment, lip 22 terminates at its innermost extension at a reduced volume tip that approximates a nib or point.

Housing wall 24 is configured along its interior surface 26 with a predetermined curvature that maintains a selected restricted space (i.e., spacing) 29 between wall surface 26 and the surface of ball 18 in both the closed (FIG. 1) and open (FIG. 2) positions of the ball (as hereinafter explained), and with a predetermined thickness selected to provide a desired amount of flexibility, at least in the area of wall 24 proximate lip 22, suitable to maintain an effective predetermined engagement of lip 22 with and against the ball surface with the ball in the closed position (FIG. 1) and, in some embodiments of the inventive applicator, as the ball is operatively pressed selectively proximally inward from the closed position (FIG. 1) to the open position, i.e., the application position (FIG. 2), for effecting the dispensing of stored liquid. For example, the spacing between the interior surface 26 and the surface of the ball 18 may gradually diminish in a distal direction of the housing so that the portion near the lip 22 is the narrowest part. Furthermore, the housing wall may be configured so that the spacing between the interior surface 26 and the surface of the ball 18 becomes more uniform around the portion of the circumference of the ball 18 disposed in the dispensing chamber 14 as the ball is moved proximally toward the open-valve condition. This configuration can reduce leakage by reducing the amount of liquid near the lip while still a uniform distribution of liquid on the applicator ball 18. The spacing between the interior surface 26 and the surface of the ball 18 may be configured so that a portion of the restricted space 29 is available as a liquid reservoir even when the ball 18 is in its most proximal position. This configuration allows the applicator ball 18 to be wicked after only a single rotation, even if the applicator has not been used for a period of time, because residual liquid will remain in the restricted space 29.

In addition, the predetermined curvature of the interior surface 26 of the housing wall 24 determines, in part, the distance through which the applicator ball 18 travels between the closed (FIG. 1) and open (FIG. 2) positions. This allows the travel distance of the applicator ball 18 to be set such that the applicator ball 18 contacts the bottom of the interior surface 26 in the open position, thereby providing a tactile response as the user applies pressure to the applicator ball 18 to apply the liquid. The "clicking" sensation perceived by the user as the applicator ball 18 contacts the bottom of the interior surface 26 can serve as confirmation for the user that the applicator ball 18 is in a proper position to apply liquid.

The configuring of housing wall 24 to provide both the desired spacing between wall surface 26 and the ball surface, on the one hand, and the desired flexibility of the distal end of housing wall 24 at lip 22 to maintain the desired effective engagement (or spacing) of lip 22 with the ball surface, on the other, are determined based on the viscosity and associated characteristics of the stored liquid to be dispensed as well as the characteristics of the material of construction of the applicator housing.

Upper housing wall 24 terminates at its lower or proximal end at a preferably circular valve opening that both separates and connects the feed chamber 16 and the dispensing chamber 14 and defines along its proximal edge an annular valve seat 27. Seat 27, in particular embodiments, provides a fairly abrupt edge along its proximal extension to assure effective closure and sealing of the valve opening in the closed-valve condition of the applicator. In other embodiments, the valve seat 27 may have a proximal edge of a reduced thickness (see, e.g., FIG. 15) such that a portion of the valve seat 27 may extend over a portion of the valve surface 42. This configuration can provide a tighter seal, which can help prevent leakage, especially for liquids of lower viscosity.

The inner diameter of the valve seat 27 may be determined based at least in part on the viscosity of the liquid to be dispensed. For example, a range of orifice sizes for the inner diameter of the valve seat 27 may be between about 0.17 and about 0.38 inches. Various values within this range may be used depending on the particular application, such as, for example, an inner diameter of 0.17 inches for low viscosity liquid (e.g., thin perfume or oil), 0.26 inches for liquids of moderate viscosity (e.g., oils, thin serum), and 0.38 inches for liquids of high viscosity (e.g., thick serum).

Figure 7:
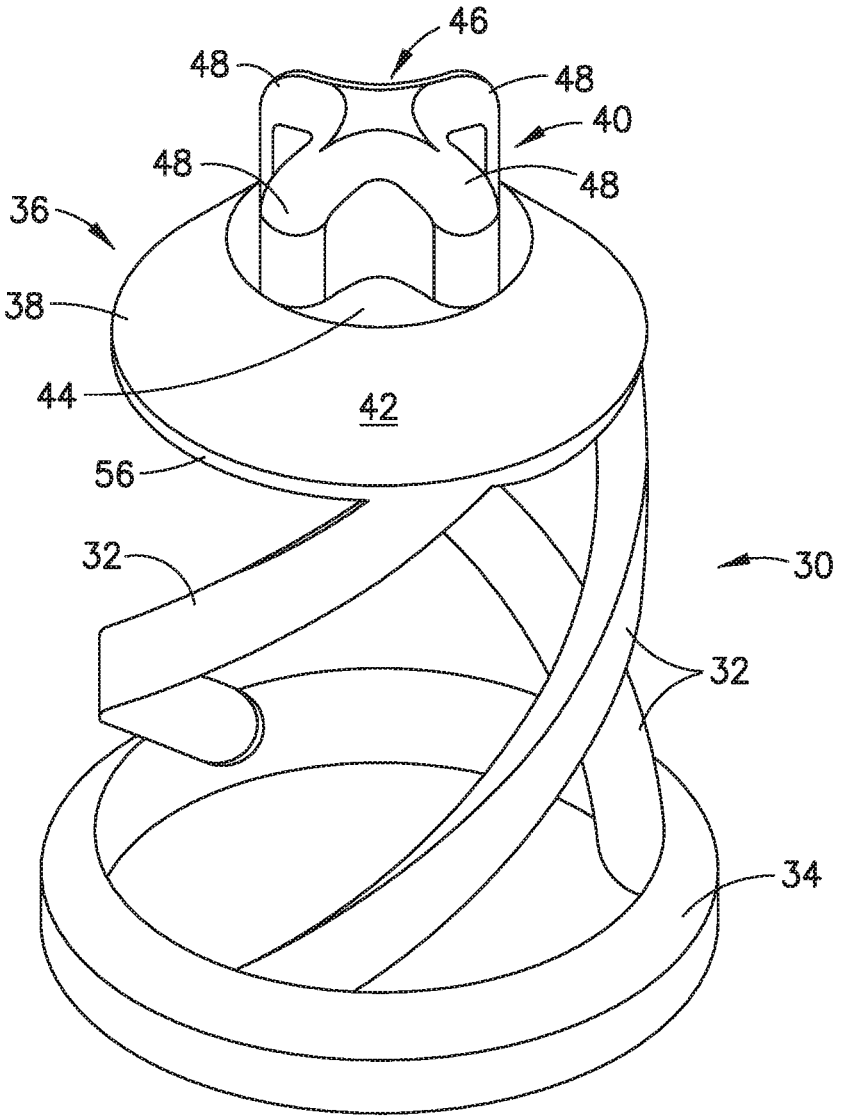
FIG. 7 is a perspective view of an embodiment of the spring in which the valve head has a depression in the central portion.

The proximally-disposed feed chamber 16 is at least laterally defined by a lower housing wall 28 that is configured to envelop and retain a spring element which provides spring compression force, e.g., spring 30. Spring 30, as seen in FIG. 7, may be unitarily constructed of a plastic material and comprises a number of (e.g., three) helically-arranged bands, i.e., splines 32 that extend longitudinally between a proximal base 34 and a distal valve head 36. Those skilled in the art will appreciate that variations of spring 30 that have, for example, only a single helically-arranged band, or two bands or greater than three bands, are nevertheless also within the intended scope and contemplation of the invention. Spring base 34 is formed as a centrally-open tubular web from which the splines 32 distally extend and, with reference to FIGS. 1 and 2, in the assembled form of applicator 10 the base 34 rests against and/or may be swaged or otherwise coupled or joined to a flange 37 that bounds the open bottom end of housing 12 and projects radially inward at the proximal end of lower housing wall 28 to captively retain the base end of spring 30 within dispensing chamber 14. This arrangement permits a substantially unobstructed flow of liquid from its associated storage container or bottle (not shown) through the opening bounded by flange 37 and into the feed chamber 16 of housing 12.

Figure 3:
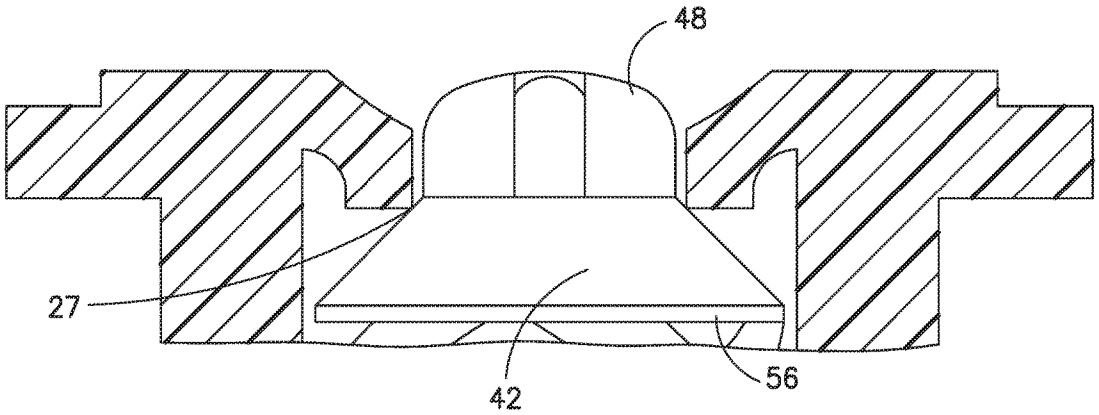
FIG. 3 is an enlarged portion of the cross-sectional view of FIG. 1 showing the valve head contacting the valve opening in the closed-valve position.
Figure 4:
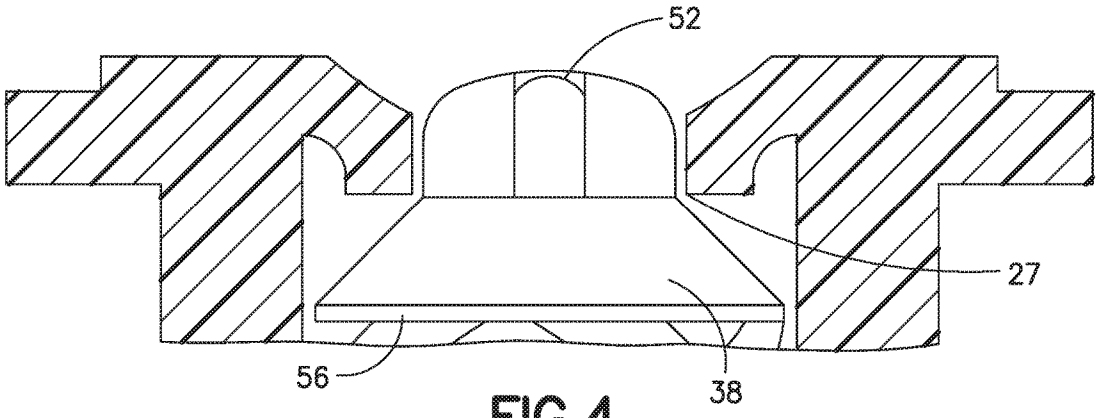
FIG. 4 is an enlarged portion of the cross-sectional view of FIG. 2 showing the valve head spaced apart from the valve opening in the open-valve position.

Valve head 36 of spring 30 comprises a proximal frustoconical annular body 38 and a distal ball support structure 40 that longitudinally extends distally from body 38. Frustoconical body 38, to which the distal ends of splines 32 are attached, defines a frustoconical valve surface 42. In the operation of applicator 10, surface 42 is longitudinally displaced or translated between contact with (see FIG. 1) and disengagement from (see FIG. 2) valve seat 27 to respectively close and open the passageway through valve opening 25 through which liquid to be dispensed is selectively flowable from feed chamber 16 into dispensing chamber 14; see also FIGS. 3 and 4. Thus, FIGS. 1 and 3 depict the closed-valve condition of applicator 10, and FIGS. 2 and 4 depict the open-valve condition. Spring 30 is compressively captured within feed chamber 16, such that helical bands, i.e., splines 32 apply, in both the closed-valve and open-valve conditions, distally-directed force to normally press moveable valve surface 42 against fixed valve seat 27 to thereby positively maintain a sealing closure of the passageway of opening 25 against the flow of liquid from feed chamber 16 into dispensing chamber 14, i.e., the closed-valve condition of applicator 10. When the applicator is selectively operated by a user to open the valve as shown in FIGS. 2 and 4 to dispense liquid onto a worksurface, the helical members likewise provide the distally-directed force to return the valve to its closed condition when the user discontinues liquid-dispensing operation of the applicator.

Also positioned in feed chamber 16 are a plurality of longitudinally-extending ribs 54 that depend radially-inward from sidewall 28. In the herein illustrated and described embodiment of applicator 10, four such ribs 54 are distributed at substantially equal intervals about the lateral bounds of chamber 16, although modifications to provide fewer or greater than four ribs, changes in their relative spacings within and circumferentially around the feed chamber 16, and variations from the substantially rectangular form of the ribs shown in the Figures may be incorporated in the construction of the applicator. Ribs 54 are effective to assist in maintaining longitudinal translation and displacement, and thus avoiding unintended off-axis movement of valve head 36, and more particularly of frustoconical body 38, as valve head 36 is inwardly displaced from and subsequently returned to its closed-valve position. Toward that end, ribs 54 extend inwardly from sidewall 28 by an amount that substantially corresponds to almost the position of the proximal rim or edge 56 of surface 42 in the assembled condition of applicator 10. Ribs 54 also similarly assist in proper positioning of the valve head 36 (and, thereby, in the ease of assembly of applicator 10) as the spring member is distally inserted into feed chamber 16 as the applicator is assembled. Embodiments of the applicator in which the proximal edge 56 of body 38 includes small grooves or slots or cut-outs (not shown) along and within which the innermost longitudinal edges of the ribs 54 are captively but otherwise freely moveable are also within the intended scope and contemplation of the invention.

The structural features of ball support body 40 of spring valve head 36 are perhaps best seen in FIG. 7. Support body 40 rises from a solid platform 44 defined at or proximate the distal top of valve surface 42 and comprises a multi-lobed land 46 that defines four flutes or legs 48 that extend radially outward from a central core section 50. Although as shown the flutes 48 are substantially equally positioned about core 50, constructions of body 40, or head 36, in which other radial spacing arrangements are implemented are also within the intended scope and contemplation of the invention. In the assembled condition of applicator 10, body 40 extends distally into dispensing chamber 14 through valve opening 25 such that the surface of ball 18 rests supportedly on flutes 48. As a consequence, it is preferred for ease of operation that the height of each flute 48 above platform 44 in this embodiment of spring 30 be substantially the same.

User-effected inward displacement of ball 18, i.e., when the inverted applicator is pressed against a worksurface onto which stored liquid is to be deposited or applied, in turn proximally displaces support body 40, on which the ball is supported, and with it the valve surface 42 of valve head 36, to separate the displaced frustoconical valve surface 42 from engagement with valve seat 27 and thereby define between them an open valve flow passage through which liquid from feed chamber 16 can advance—at least under the force of gravity—into dispensing chamber 14; see FIGS. 3 and 4. The liquid flow into the dispensing chamber fills or otherwise collects in the restricted space 29 defined between the ball surface and the opposed housing wall surface 26. As the outwardly projecting surface of the ball is pressed against and the applicator is manipulated along the worksurface, the ball rotates within dispensing chamber 14 and the rotating ball surface picks up and carries liquid from restricted space 29, outwardly past lip 22 and onto the worksurface.

The amount of stored liquid that is dispensed onto the surface of the ball for application to the workpiece, when the applicator is operated by user manipulation to open the valve, can be controlled by suitable selection of the resulting volume of the restricted space 29, which itself will be formulated to take account of the viscosity and other flow and adhesion characteristics and the like of the liquid to be dispensed. Notably, a portion of the restricted space 29 is available as a liquid reservoir even when the ball 18 is in its most proximal position. Control of the amount of stored liquid that is operatively dispensed onto the worksurface may also be influenced by specifying or adjusting the configuration and/or other characteristics of the upper housing wall 24 in (at least) the area of lip 22 to effect continuing contact between lip 22 and the surface of ball 18, or to alternatively accommodate a predetermined spacing between lip 22 and the surface of ball 18, as the ball is inwardly (proximally) displaced to effect a discharge of stored liquid onto the worksurface during operation of the applicator.

As previously explained, in preferred forms of the inventive applicator 10 the upper housing wall, particularly in the area of annular lip 22, is configured and constructed of a material that provides a desired amount of flexibility in the area of lip 22. This preferred flexibility is at least in part intended to assure an even tighter effective seal against leakage or other uncontrolled release of stored liquid when a cap closure is engaged about the distal end of applicator 10 and discharge opening 20 during extended periods of nonuse or storage, as will hereinafter be explained. This flexibility also assures that, in some forms of the inventive applicator, when ball 18 is inwardly (i.e. proximally) depressed during use of the applicator to open the valve and selectively deposit liquid onto the desired worksurface through rolling contact with the ball surface, sufficient contact is maintained (or a predetermined spacing is accommodated) between the discharge lip 22 and the ball surface to prevent liquid contained in the restricted space 29 from uncontrolled release, i.e., release through the discharge opening 20 other than on and along the surface of ball 18. It is of course intended that the effectiveness of that closure be suitably less than the tighter seal provided between lip 22 and the ball surface during periods of nonuse, when the spring force of element 30 drives flutes 48 of spring valve head 36 distally against the ball surface to maintain an effective liquid-tight engagement of the ball surface and lip 22, or during periods of extended nonuse or storage when an associated cap closure further constrains the passage of stored liquid outwardly through discharge opening 20.

The appropriate degree of flexibility of upper housing wall 24 proximate lip 22, and the resulting force with which lip 22 continues to press against (or maintains a predetermined spacing with) the ball surface when ball 18 is inwardly depressed (to the valve-open condition) for user-controlled liquid deposit on a worksurface, are determined based at least in part on the viscosity and related characteristics of the liquid to be dispensed. Thus, the greater the viscosity of the liquid, the less the requirement that lip 22 maintain in the open-valve condition close (or at least closer) contact with the ball surface to prevent unintended leakage of liquid at lip 22.

In the form of the valve head 36 shown in FIG. 7, the topmost elevations of the flutes 48 comprise the highest points on valve head 36, i.e., the points or regions on which the surface of ball 18 supportedly rests. In this construction, the portion of valve head 36 that defines central core 50 has a lesser elevation, than the flutes 48, above platform 44 and thus forms a small indentation or depression or trough 52 or the like. Among other things, this depression—whatever its configuration and contours—assures that the surface of ball 18 rests firmly on the flutes 48 without interference from the central core.

Figure 8:
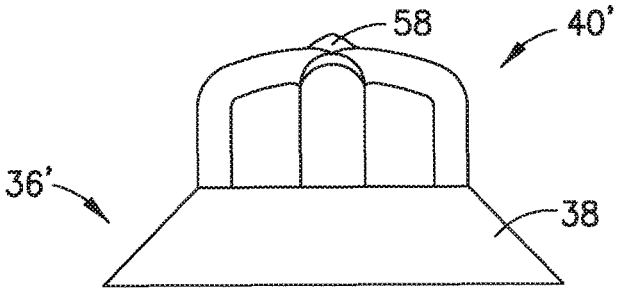
FIG. 8 is a side view of an embodiment of the valve head having an applicator ball support structure with a projection or dimple.
Figure 9:
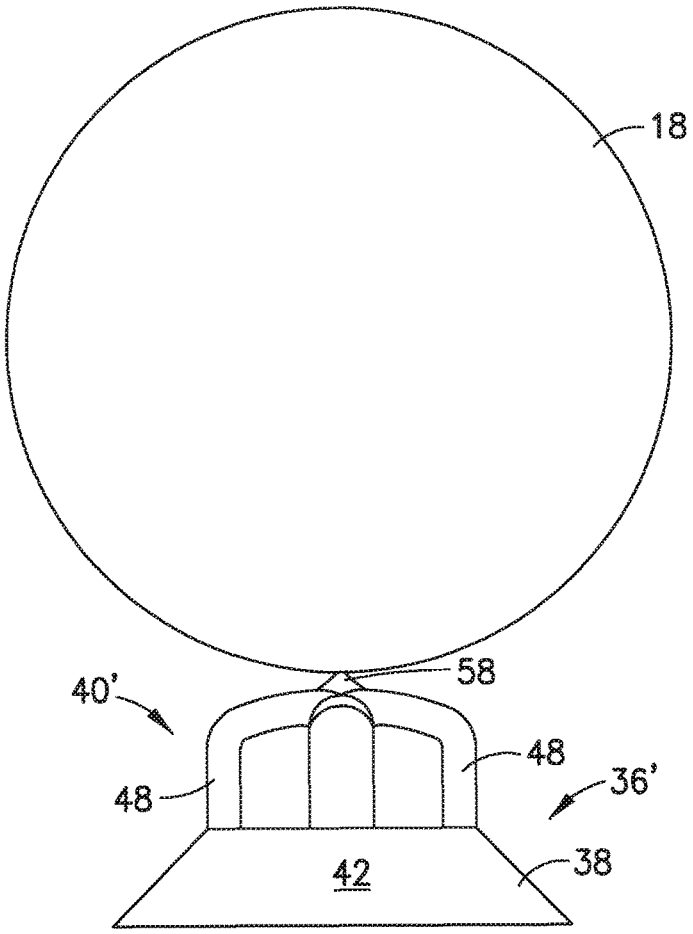
FIG. 9 depicts the valve head of FIG. 8 in contact with an applicator ball.

Depicted in FIGS. 8 and 9 is a modified construction of valve head 36' and, more particularly of the ball support body 40'. In this modified form, the central core or hub 50 is not characterized by an indentation or depression of a height less than the height of the flutes 48. Instead, a small projection or dimple 58 that extends upwardly/distally above the height of flutes 48 is defined proximate the center of core 50. As shown in FIG. 9, with this modification of body 40 ball 18 rests not on flutes 48 but, instead, on dimple 58. This alternate construction has been found to provide enhanced ease of rotation of ball 18 and enhanced distribution of liquid onto the surface of ball 18. It will be appreciated that the former advantage is particularly realized by minimizing the lateral extent of the distal top of dimple 58 on which ball 18 rests. The latter advantage can be further enhanced by including on the central core, about the dimple 58, a slight indentation or depression.

FIGS. 10-12, discussed in detail below, present alternative embodiments of the valve head 36. A particular configuration of the valve head may be selected based at least in part on the viscosity of the liquid to be dispensed.

Figure 10B:
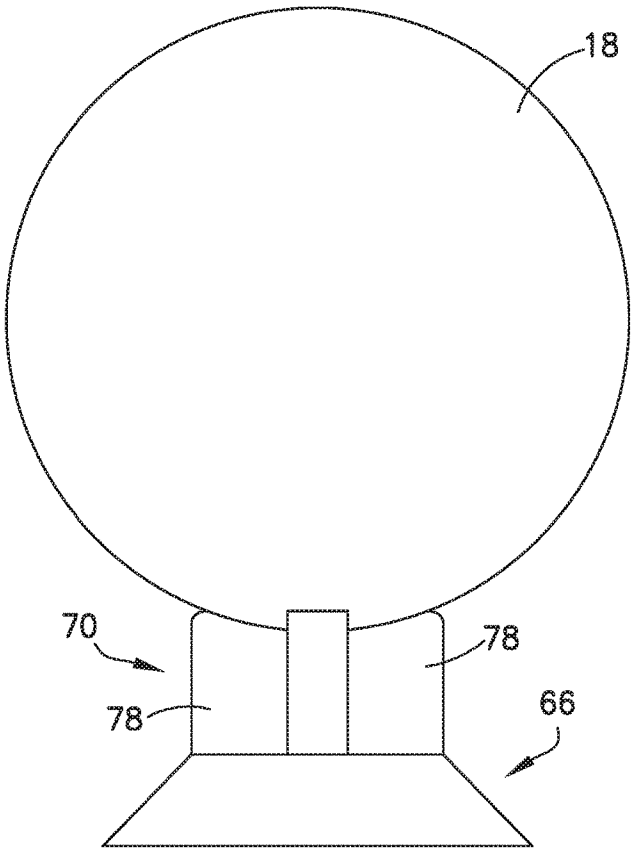
FIG. 10B is side view of the embodiment of the valve head depicted in FIG. 10A showing an applicator ball resting in an applicator ball support structure formed by the flutes.
Figure 10A:
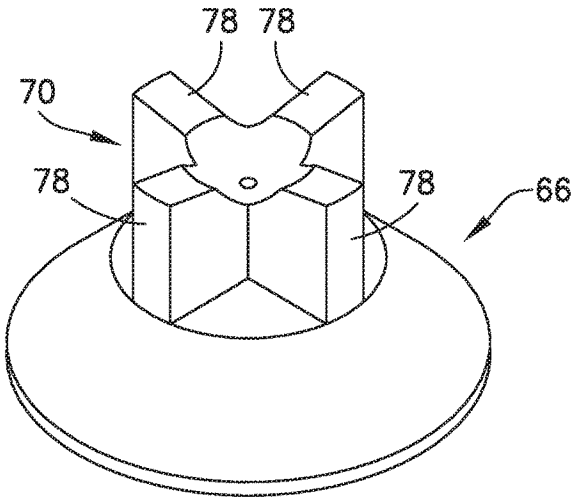
FIG. 10A is a perspective view of an embodiment of the valve head having flutes which incline upwardly toward the outer edge of the valve head.

FIG. 10A is a perspective view of an embodiment of the valve head 66 having a ball support body 70 with flutes 78 which incline upwardly toward the outermost ends thereof. FIG. 10B is side view of the embodiment of the valve head 66 depicted in FIG. 10A showing an applicator ball 18 resting in the ball support body 70 formed by the flutes 78. In this embodiment, additional friction, relative to the embodiments of FIGS. 7-9, arises because the applicator ball 18 rests on the four flutes 78, rather than on a dimple or intersection of flutes. However, this may be desirable with particular liquids, such as, for example, liquids of medium viscosity. Furthermore, the flues 78 hold the applicator ball more stably than a dimple, which can improve performance of the applicator. FIG. 10C is a side view of an embodiment of a spring 30 having the valve head 66 depicted in FIG. 10A.

Figure 10D:
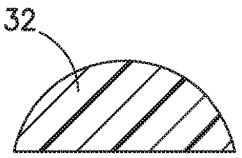
FIG. 10D cross-sectional view of a spline of the spring depicted in FIG. 10C.
Figure 10C:
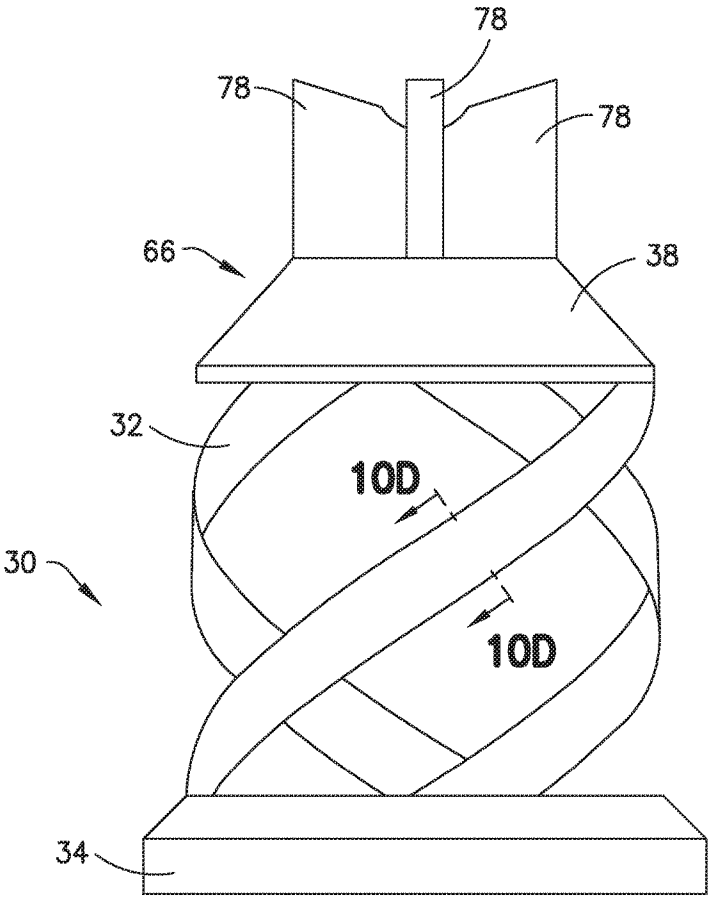
FIG. 10C is a side view of an embodiment of a spring having the valve head depicted in FIG. 10A.

FIG. 10D is a cross-sectional view of a spline of the spring depicted in FIG. 10C. As discussed above, the spring 30 (see FIG. 7) may be unitarily constructed of a plastic material and comprises a number of helically-arranged bands, i.e., splines 32 that extend longitudinally between a proximal base 34 and a distal valve head 36. The splines may, for example, have a semi-circular or semi-elliptical cross-section or a cross-section which is a circular segment (e.g., as shown in FIG. 10D) or an elliptical segment, as well as various other shapes, such as, for example, square, rectangular, or trapezoidal.

The force exerted by the spring 30 as it is compressed, i.e., the spring force, may be adjusted to meet particular requirements by changing the shape and/or size of the cross section of the spline, as well as by changing the number of splines. The required spring force for any particular application depends at least in part on the viscosity of the liquid to be dispensed. Liquids of lower viscosity call for a greater spring force to prevent leakage and or excessive flow of the liquid. Liquids of higher viscosity, on the other hand, call for a smaller spring force to allow a sufficient quantity of liquid to flow. For a circular segment-shaped spline a diameter range of between about 0.062 and about 0.074 inches may be used with a segment width of between about 0.02 and about 0.04 inches. A larger spline width results in a greater spring force. Various values of spline width within this range may be used depending on the particular application, such as, for example, an spline width of 0.04 inches for low viscosity liquid (e.g., thin perfume or oil), 0.03 inches for liquids of moderate viscosity (e.g., oils, thin serum), and 0.02 inches for liquids of high viscosity (e.g., thick serum).

Figure 11B:
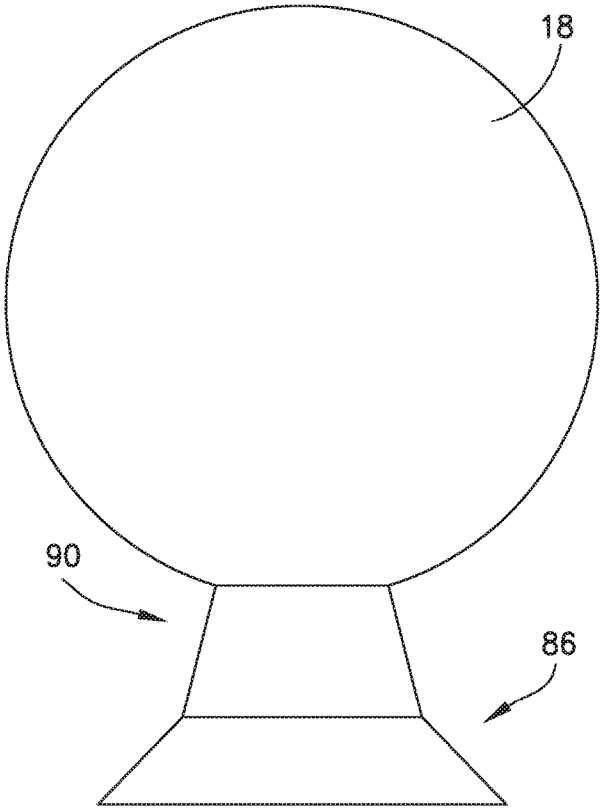
FIG. 11B is side view of the embodiment of the valve head depicted in FIG. 11A showing an applicator ball resting in the applicator ball support structure formed by the hole.
Figure 11A:
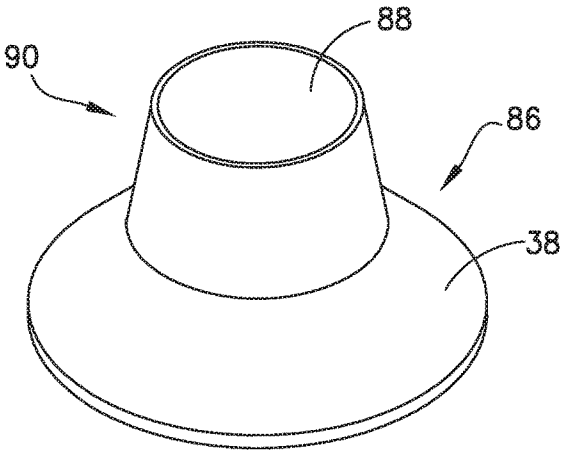
FIG. 11A is a perspective view of an embodiment of the valve head having a hole in a central portion thereof.

FIG. 11A is a perspective view of an embodiment of the valve head 86 having a ball support body 90 with a frustoconical shape, and with a hole 88 formed in a central portion thereof, on a frustoconical body 38. FIG. 11B is side view of the embodiment of the valve head 86 depicted in FIG. 11A showing an applicator ball 18 resting in the hole 88 in the ball support body 90. In this embodiment, the hole 88 formed in the central portion of the ball support body 90 serves both as a support for the applicator ball 18 and as an additional path through which fluid may flow from the feed chamber 16 into the dispensing chamber 14. Such a configuration can be useful with particular types of liquid, such as, for example, liquids of higher viscosity.

Figure 12B:
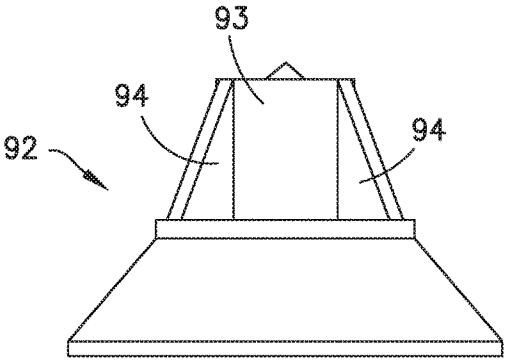
FIG. 12B is side view of the embodiment of the valve head depicted in FIG. 12A.
Figure 12A:
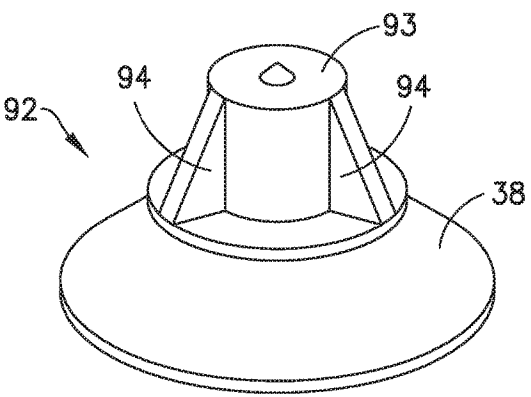
FIG. 12A is an isometric view of an embodiment of the valve head having flutes that slant downward toward the outer edge of the valve head.

FIG. 12A is an isometric view of an embodiment of the valve head 92 having flutes 94 that slant downward toward the outer edge of the valve head 92. The flutes 94 extend from a solid cylindrical central portion 93. In the depicted embodiment, there are three flutes 94, but the number of flutes may vary depending upon the particular application. The flutes, in effect, for channels through which liquid can flow as the valve head 92 is pushed away from the valve seat 27 by the movement of the applicator ball 18. FIG. 12B is side view of the embodiment of the valve head depicted in FIG. 12A.

Figure 13B:
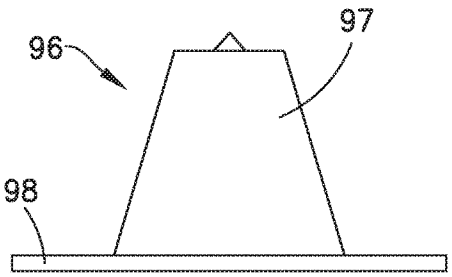
FIG. 13B is side view of the embodiment of the valve head depicted in FIG. 13A.
Figure 13A:
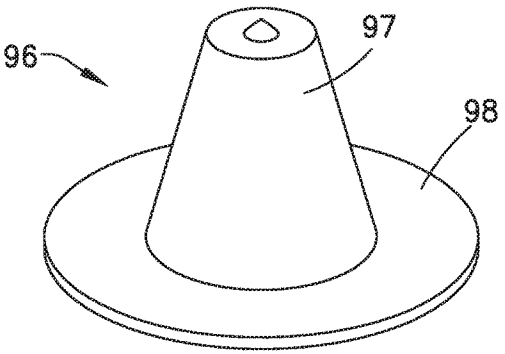
FIG. 13A is an isometric view of an embodiment of the valve head having a solid ball support structure with a frustoconical shape on a disk-shaped base.

FIG. 13A is an isometric view of an embodiment of the valve head 96 having a solid ball support structure 97 with a frustoconical shape on a disk-shaped base 98. This embodiment differs in that there are no flutes, and the ball support structure 97 formed on a flat base 98, rather than a frustoconical body portion (e.g., FIG. 12A, ref. no. 38). The absence of flutes results in a lesser flow of liquid between the valve head 96 and the valve seat 27 because there are no channels formed by the flutes. FIG. 13B is side view of the embodiment of the valve head depicted in FIG. 13A.

The valve head embodiments discussed above may be used depending on the particular application, such as, for example, the embodiment of FIGS. 13A and 13B may be used for low viscosity liquid (e.g., thin perfume or oil), the embodiment of FIGS. 10A-D may be used for liquids of moderate viscosity (e.g., oils, thin serum) or thick viscosity (e.g., thick serum), and the embodiment of FIGS. 11A and 11B may be used for liquids of high viscosity (e.g., thick serum).

After assembly of the applicator 10, it is generally intended that the applicator will be connected to a bottle or container or pouch or other body that holds a supply of the liquid to be dispensed. It is contemplated that the liquid container (not shown) will be secured, as for example by an interference fit, and generally although not necessarily non-removably, to the proximal end of the applicator 10 shown in the figures. Securement of the liquid container may be effected in any known or otherwise desired manner, as for example below and butting up against the lower/proximal face of a collar or flange 60 in the illustrated embodiment. Forms of the inventive applicator in which the liquid storage container or reservoir is implemented as a unitary extension of part of the housing 12—with, by way of illustrative example, an opening or other construction through which the reservoir may be filled, during or after assembly, with the liquid to be dispensed—are also within the scope and contemplation of the invention.

Figure 14:
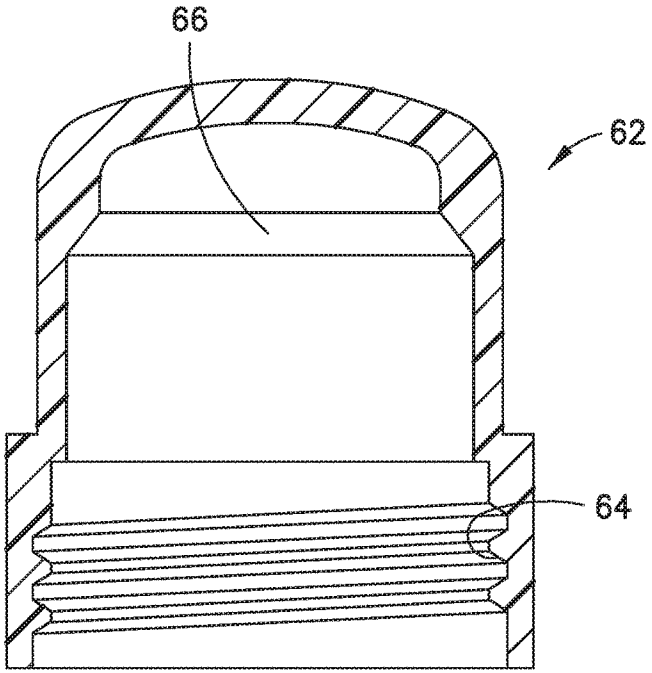
FIG. 14 is a cross-sectional view of a cap for closing the outlet of the applicator housing.

The upper/distal face of collar 60 may serve as the stop for a closure cap or cover 62, shown by way of example in FIG. 14, for enveloping the discharge opening 20 and upper housing wall 24 during periods, such as extended periods between instances of operative use or during transport or storage), of non-use of applicator 10. The outer face of upper housing wall 24 may carry threads (or alternatively, such threads 68 may, as shown by way of example in FIG. 15, be defined on a surface portion of the liquid container or pouch 70) or other suitable engagement structure(s) for mating engagement with corresponding internal threads 64 or other features on cap 62 to retain the cap in enveloping position about the distal end of the applicator. In preferred forms of the applicator, the flexibility of upper housing wall 24 of housing 12 enables the cap 62, when coupled to housing 12, to inwardly flex the wall 24 at lip 22 and thereby further enhance and assure a tight sealing closure formed between annular lip 22 and the surface of ball 18, thus virtually eliminating liquid leakage from the applicator into the cap. Cap 62 may accordingly include an interior, annular, radially-inwardly angled or otherwise configured shoulder 66 positioned and shaped to press against wall 24 proximate lip 22 to thus radially inwardly displace lip 22 of flexible wall 24 into liquid-tight sealing engagement with the surface of ball 18. It is generally contemplated that this enhanced engagement of lip 22 against the ball surface will suffice to effectively prevent rotation of ball 18 within dispensing chamber 14 and relative to lip 22.

Figure 15:
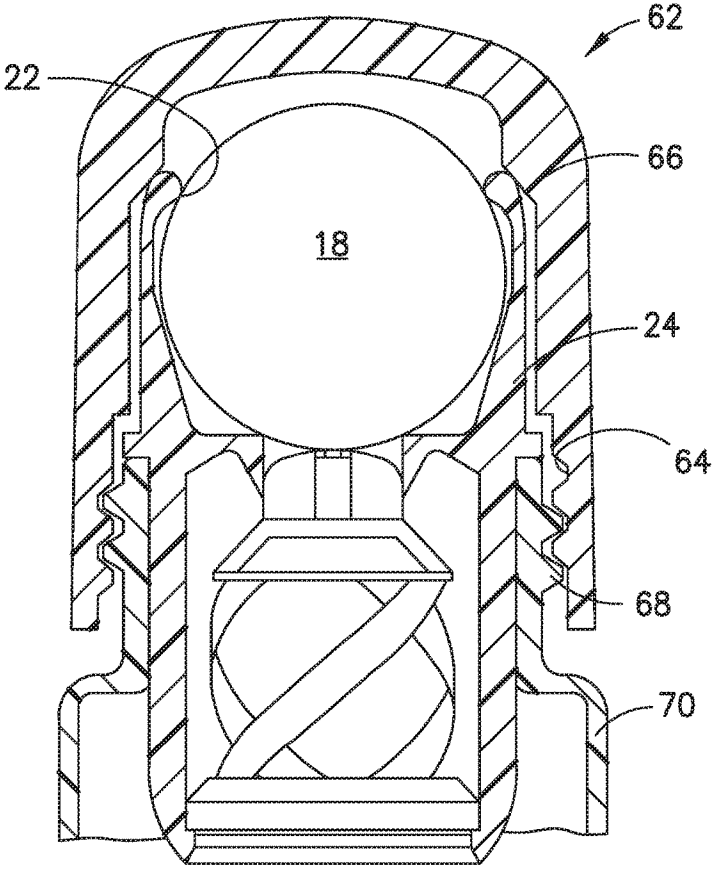
FIG. 15 is a cross-sectional view of a liquid applicator and cap attached to threaded portions of a liquid container in which the applicator is installed.

FIG. 15 depicts cap 62 fully threadedly engaged with and about the distal (discharge) end of applicator 10. Interior annual cap shoulder 66 is seen pressing inwardly against the distal end of flexible upper housing wall 24, at lip 22, to displace it fluid-tightly against and to form an enhance seal with the surface of ball 18. It will be noted that the shaping of cap shoulder 66 shown in FIG. 15 differs from that depicted in FIG. 14, and such differences (as well as additional suitable variations and modifications not expressly discussed or shown herein) in the construction, details, features and shaping of the cap are deemed to be within the scope and contemplation of the invention.

Although example embodiments have been shown and described in this specification and figures, it would be appreciated by those skilled in the art that changes may be made to the illustrated and/or described example embodiments without departing from their principles and spirit.

What is claimed is:

1. A liquid applicator comprising:

a housing having a feed chamber, a dispensing chamber in communication with the feed chamber via a valve opening, an inlet at an axially proximal end of the housing through which a stored liquid is receivable in the feed chamber and an outlet at an axially distal end of the housing through which the stored liquid is dispensable from the dispensing chamber;

an applicator ball disposed within the dispensing chamber and partially extending outward therefrom through the outlet, the dispensing chamber being configured to allow the applicator ball to move at least in an axial direction between a closed-valve position and an open-valve position, the applicator ball being retained in the dispensing chamber by an annular lip at the distal end of the housing which extends radially inward;

a cap releasably securable to the housing about the applicator ball;

a spring element disposed within the feed chamber, the spring element having a base portion and a valve head portion, the base portion being supported at a proximal end of the feed chamber, the valve head portion being moveable between a closed-valve position in which the valve head is in contact with the valve opening and an open-valve position in which the valve head is displaced in an axial direction with respect to the valve opening, wherein the spring element is maintained in a compressed state such that the spring element applies, in both the closed-valve position and the open-valve position, distally-directed force to press the valve head against the valve opening to maintain a sealing closure of the valve opening against flow of the liquid from the feed chamber into the dispensing chamber, wherein the valve head comprises a ball support structure which extends distally through the valve opening to contact the applicator ball so that when the ball is proximally displaced by force applied thereto, the valve head moves axially from the closed-valve position to the open-valve position, thereby moving the valve head toward the open-valve position which allows liquid from the feed chamber to enter the dispensing chamber, and the dispensing chamber bounded between the annular lip at the distal end, an interior surface of the housing, and a surface of the applicator ball, the dispensing chamber having a determined spacing characteristic providing at least a portion of the stored liquid to be available when the cap is secured to the housing and the applicator ball is in a most proximal position.

2. The liquid applicator of claim 1, wherein the dispensing chamber is configured along an interior surface thereof with a curvature that maintains the determined spacing characteristic between the interior surface and the surface of the applicator ball.

3. The liquid applicator of claim 2, wherein the spacing characteristic is determined so that the spacing between the interior surface and the surface of the applicator ball diminishes in a distal direction of the housing.

4. The liquid applicator of claim 2, wherein the spacing characteristic is determined so that a travel distance of the applicator ball is set such that the applicator ball contacts a bottom of the interior surface in the open-valve position, thereby providing a tactile response as a user applies pressure to the applicator ball to apply the liquid.

5. The liquid applicator of claim 1, wherein a valve seat at the valve opening has a proximal edge of a reduced thickness and the valve head has a periphery surface such that a portion of the valve seat extends over at least a portion of the periphery surface of the valve head when the valve head is in the closed-valve position.

6. The liquid applicator of claim 1, wherein the spring element is unitarily constructed of a plastic material and comprises a plurality of helically-arranged splines that extend longitudinally between the valve head and the base portion of the spring element.

7. The liquid applicator of claim 6 wherein the splines have a circular segment cross-section with a diameter range of between about 0.062 and about 0.074 inches and a segment width of between about 0.02 and about 0.04 inches.

8. The liquid applicator of claim 1, wherein the feed chamber comprises a plurality of longitudinally-extending ribs that extend radially-inward from the interior surface of a wall forming the feed chamber, the ribs being configured to maintain contact with an outer circumferential surface of the valve head during longitudinal translation and displacement of the valve head.

9. The liquid applicator of claim 1, wherein the valve head comprises a frustoconical annular body at the proximal end thereof and the ball support structure at the distal end thereof.

10. The liquid applicator of claim 9, wherein the ball support structure extends distally from a top surface of the valve head and comprises a multi-lobed land that defines flutes that extend radially outward from a central portion of the top surface of the valve head.

11. The liquid applicator of claim 10, wherein the force of the spring element drives the flutes of the valve head distally against the applicator ball to maintain a liquid-tight engagement of the applicator ball and the lip.

12. The liquid applicator of claim 10, wherein the flutes incline upwardly toward the radially outermost ends thereof.

13. The liquid applicator of claim 10, wherein a central portion of the ball support structure has a lesser elevation than a surrounding portion of the ball support structure, thereby forming a depression in which the applicator ball rests.

14. The liquid applicator of claim 10, wherein a central portion of the ball support structure has a higher elevation than a surrounding portion of the ball support structure, thereby forming a projection that extends distally to contact the applicator ball.

15. The liquid applicator of claim 14, wherein the central portion of the ball support structure comprises a depression encircling the projection.

16. The liquid applicator of claim 9, wherein the ball support structure extends distally from a top surface of the valve head and comprises a hole in a central portion of the top surface of the valve head, an outer edge of the hole forming the most distal extent of the valve head.

17. The liquid applicator of claim 9, wherein the valve head has flutes that extend from a solid cylindrical central portion and slant linearly downward toward the outer edge of the valve head.

18. The liquid applicator of claim 1, wherein the valve head comprises a solid ball support structure with a frustoconical shape on a disk-shaped base.

19. The liquid applicator of claim 1, further comprising a cap having an interior annular shoulder portion positioned and shaped to press against a distal portion of the housing to radially inwardly displace the lip into a liquid-tight sealing engagement with the applicator ball.

20. The liquid applicator of claim 1, wherein the lip terminates at an innermost extension at a reduced volume nib edge.

21. The liquid applicator of claim 1, wherein the housing is formed of plastic as a unitary element.

22. The liquid applicator of claim 1, wherein an inner diameter of the valve seat is between about 0.17 and about 0.38 inches.

23. A container comprising the liquid applicator of claim 1, installed in an opening thereof.

* * * * *